United States Patent [19]

Tracy

[11] 4,218,014

[45] Aug. 19, 1980

[54] MULTIPLE FLAVOR POST-MIX BEVERAGE DISPENSING HEAD

[75] Inventor: Gene A. Tracy, Amery, Wis.

[73] Assignee: The Cornelius Company, Anoka, Minn.

[21] Appl. No.: 13,102

[22] Filed: Feb. 21, 1979

[51] Int. Cl.[3] ..... B67D 5/56

[52] U.S. Cl. ..... 239/106; 222/144.5; 222/145; 239/417.5; 239/432; 366/336

[58] Field of Search ..... 239/104, 106, 120, 304, 239/305, 417.5, 423, 432, 433; 222/129.1, 144.5, 145; 366/336, 337, 338, 340

[56] References Cited

U.S. PATENT DOCUMENTS

| | | | |
|---|---|---|---|
| 2,770,502 | 11/1956 | Hodge | 239/417.3 |
| 3,289,948 | 12/1966 | Fuerst | 222/145 X |
| 3,455,332 | 7/1969 | Cornelius | 222/145 X |
| 3,867,962 | 2/1975 | Gerrard | 222/144.5 X |

*Primary Examiner*—Andres Kashnikow
*Attorney, Agent, or Firm*—Henry C. Kovar

[57] ABSTRACT

A multiple flavor post-mix beverage dispensing head has a nozzle, a diluent outlet in the nozzle, a plurality of discrete concentrate outlets in the nozzle, a spout under the nozzle, an outlet from the spout for discharge of beverage from the head, and the improvements of a downward facing open concavity in the center of the nozzle and bounded by a downward facing sharp edge forming the lowest part of the nozzle, a convex bottom nozzle surface extending upwardly from the concavity sharp edge, a sharp edged and squared counterbore between the convex bottom nozzle surface and a restrictor bore in each of the concentrate outlets, sharp edges on all surface intersections on the nozzle bottom surface and rounded intersections between all surfaces in the interior of the spout, an included angle between the bottom surface of the nozzle and inner surface of the spout which is divergent toward the centerline of the spout and which turns into the spout outlet, and a toroidal diluent flooding chamber between the nozzle and the spout and outside of the concentrate outlets.

34 Claims, 3 Drawing Figures

MULTIPLE FLAVOR POST-MIX BEVERAGE DISPENSING HEAD

BACKGROUND OF THE INVENTION

1. Field of the Invention

This invention pertains to a multiple flavor post-mix beverage dispensing head for mixing any one of a plurality of different flavored liquid beverage concentrates with a common diluent.

2. The Prior Art

There are hundreds of different structures for dispensing heads for single flavor post-mix dispensing heads. These heads may mix the concentrate with diluent water either within the head as is preferred, or merely discharge the concentrate and diluent into a cup. These single flavor heads have typically discharged concentrate in the center of the head, and discharged diluent water around the concentrate outlet in some type of concentric co-axial arrangement. The single flavor heads have never provided structure for multiple and different flavored concentrates, and the problem of cleaning the previously selected concentrate from the head so there will be no carryover into a subsequently dispensed concentrate has not been addressed.

The multiple flavor dispensing heads have been developed for pre-mix or post-mix in both fixed and movable types. Pre-mix beverage is a complete beverage that has been mixed at a bottling factory and is supplied in large vessels to the site of dispensing; post-mix beverages by contrast, are mixed together as separate flows of water and concentrate are combined together and discharged into a cup. A fixed dispensing head is rigidly fastened to some type of dispensing machine and is not movable, whereas a movable head is on the end of a length of hose and can be hand held and moved along above a counter to fill up a line of glasses without the glasses having to be moved.

A typical fixed multiple flavor pre-mix head will either have a separate outlet for each flavor or a common funnel with a single outlet into which any of the flavors can be discharged. Typical movable pre-mix heads have separate outlets for each flavor. Structure is not provided for mixing.

Typical fixed multiple flavor post-mix heads have been quite tall, have done only a so-so job of mixing water and concentrate, and have been useable only at a single flow rate. The movable multiple flavor post-mix heads have been small and useable only at a single flow rate. These heads have typically been either of the following constructions: a group of parallel open ended plastic tubes bound together and leading into a funnel, or a plastic block having a peripheral annular water outlet and a plurality of concentrate outlets either within or outside of the water outlet, and some type of funnel spout to bring the flows together. These heads have been for single flow rates, have dripped after dispensing, have foamed, and effected excessive loss of carbonation. Correct mixing has always been a problem and there are three aspects to correct mixing; specifically, residue, carryover, and Brix stratification. The residue problem is concentrate of one flavor being left in the head and being washed out during the subsequent dispensing of the next drink which may be a different flavor. Carryover is similar but may also entail suction of one or more spurious concentrates with the desired beverage, or the concentrate being dispensed may be forced up into a different flavored concentrate outlet by back pressure or reverse flow in the mixing head. Brix stratification is exemplified by a glass of beverage having mostly concentrate in the bottom and mostly water in the top. The concentrate has a much higher density than diluent water, and if insufficient mixing takes place in the head, the concentrate settles to the bottom of the glass and the flavor of the beverage is very poor; specifically, if a straw is used, the first part of the drink will be rich and the last part will be mostly water.

OBJECTS OF THE INVENTION

It is an object of the invention to provide a post-mix beverage mixing and dispensing head which is operative at volumetric flow rates varying up to two to one.

It is an object of the present invention to provide a multiple flavor post-mix beverage dispensing head which in one structure minimizes the problems of drippage, foaming, carbonation loss, carryover, and effects uniform mixing of selected concentrate with a common diluent.

It is an object of the present invention to provide an economical and physically compact post-mix beverage dispensing head that may be fixed to a beverage dispensing machine and provide a common outlet for a plurality of different flavored beverages that may be selectively mixed within the head during dispensing.

Many other advantages, features and additional objects of the present invention will become manifest to thise versed in the art upon making reference to the detailed description and accompanying drawings in which the preferred embodiment incorporating the principles of the present invention is set forth and shown by way of illustrative example.

SUMMARY OF THE INVENTION

In accordance with the principles of the present invention, a multiple flavor post-mix beverage dispensing head having a nozzle, a diluent outlet in the nozzle, a plurality of discrete concentrate outlets in the nozzle, a spout under the nozzle, and an outlet in the bottom of the spout for all beverages, has the discrete improvements of

- a downward facing open concavity in the nozzle and a sharp line of intersection between the concavity and the other nozzle bottom surface,
- a convex bottom surface in the nozzle with a counterbore between the bottom surface and each concentrate outlet,
- a nozzle bottom surface having entirely sharp lower edges and a spout having entirely rounded inner edges,
- a divergent angle between the nozzle and the inside of the spout that smoothly blends into a spout outlet, and
- a toroidal diluent flooding chamber above concentrate outlets.

ON THE DRAWING

AS SHOWN ON THE DRAWING

Figure 1:
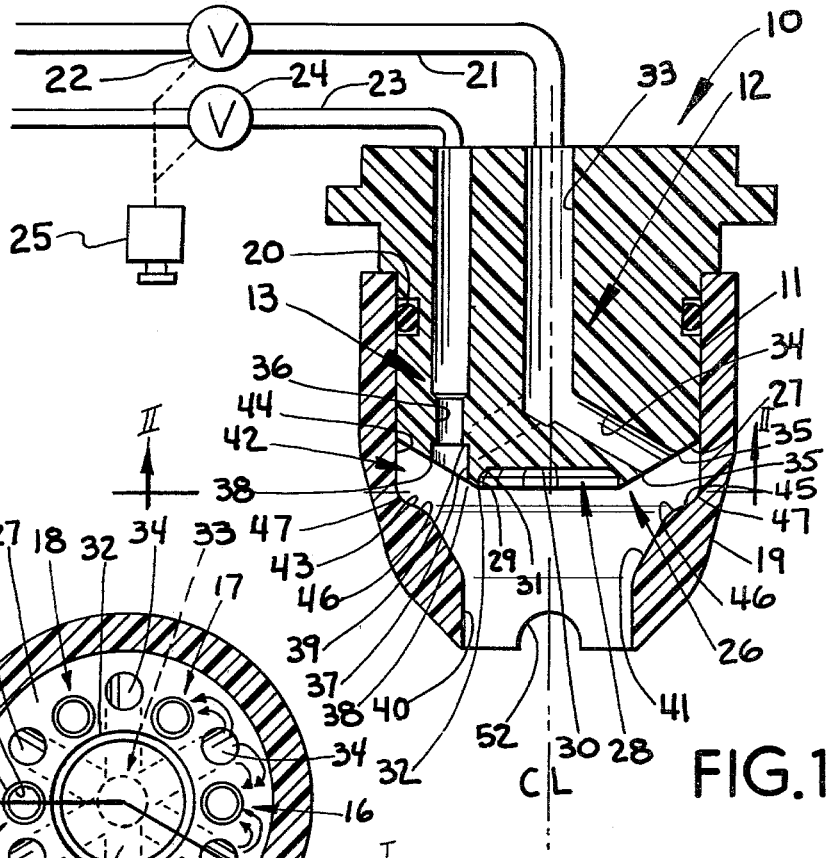
FIG. 1 is a cross-sectional elevational view taken through the preferred structural embodiment of the multiple flavor post-mix beverage dispensing head in accordance with the present invention.

The principles of the present invention are particularly useful when embodied in a multiple flavor post-mix beverage dispensing head such as that shown in FIG. 1 and generally indicated by the numeral 10. The head 10 includes a nozzle 11 having a diluent outlet 12 for carbonated water and a plurality of concentrate outlets 13, 14, 15, 16, 17, 18, all of which are identical to one another and each of which is for a different flavor of concentrate. A spout 19 is slip fitted and frictionally retained onto the nozzle 11 by an O-ring 20. The diluent outlet 12 is connectible by a conduit 21 to a source of pressurized carbonated water (not shown) and the conduit 21 is normally closed by a solenoid valve 22. Each of the concentrate outlets 13–18 is connectible by an individual respective conduit 23 to a source of pressurized beverage concentrate (not shown) and the conduit 23 is normally closed by a solenoid valve 24. Both of the solenoid valves 22, 24 are connected to a switch 25 for effecting concurrent opening of the valves 22, 24 and concurrent introduction of diluent water and concentrate into the head 10.

The nozzle 11 has a downward facing bottom surface, generally indicated by 26, which is of generally convex shape with an annular surface 27 being slanted downward toward the centerline of the head 10 and being revolved about the centerline so that the surface 27 is convexly conical. Centrally located in the nozzle bottom surface 26 and concentric to both of the head centerline (CL) and surface 27 is a downward facing open concavity generally indicated by the numeral 28. The concavity 28 is relatively shallow with the diameter being substantially greater than the depth. The concavity 28 has an internal vertical surface 29 concentric to the head centerline, and a flat upper surface 30 which is in a plane perpendicular to the head centerline. Within the concavity 28, there is an angled fillet 31 which breaks the corner of intersection between the vertical surface 29 and the upper surface 30 at about forty-five degrees. Around the bottom of the concavity 28 and at the intersection of the vertical surface 29 with the convex bottom surface 27, there is an acute angled sharp edge 32 extending continually around the entirety of the concavity 28 and facing downwardly. The concavity 28 truncates the nozzle surface 27 and the sharp edge 32 is the lowest level of the bottom surface 26 of the nozzle 11. The nozzle bottom surface 26 is well polished and the convex surface 27 surrounding the concavity 28 is angled downwardly an amount at least sufficient for effective drainage of any beverage remaining on the convex surface 27 downward to the sharp edge 32. The outer perimeter of the convex surface 27 is reasonably closely fitted to the spout 19 so that there is no liquid trap therebetween.

Figure 2:
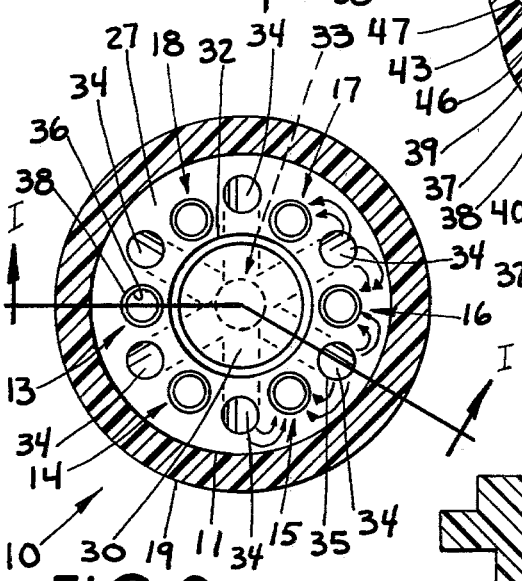
FIG. 2 is an upward looking plan view taken through lines II—II of FIG. 1; lines 1—1 in FIG. 2 denote the sectional view of FIG. 1.
Figure 3:
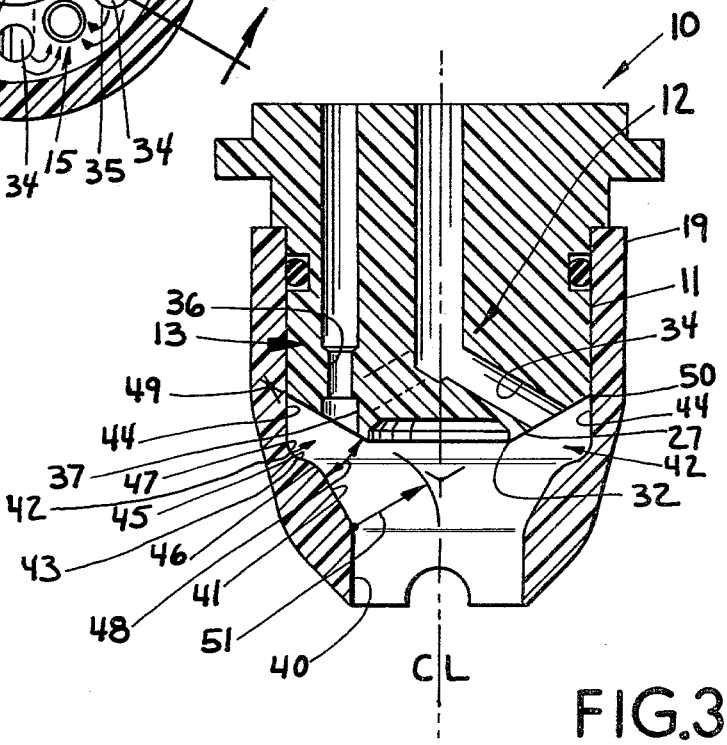
FIG. 3 is the same view as FIG. 1 with emphasis being given to the geometry of the structure.

The diluent outlet 12 has a central plenum 33 from which a plurality of runners 34 extend. The runners 34 are round bores and open through the nozzle bottom convex surface 27. A continually sharp edged outlet opening 35 is formed between the intersection of each outlet runner 34 and the nozzle surface 27. All of the outlet runners 34 acutely intersect with the nozzle convex bottom surface 27 and as seen best in FIG. 2, the plenum 33 lies on the centerline of the head 10 and the outlet runners 34 extend radially. There are shown six outlet runners 34 being evenly spaced at sixty degrees from one another, and the pattern of the runner openings 35 is circularly around, concentric with, and spaced from the concavity 28 and its associated lower sharp edge 32.

The concentrate outlets 13–18 are all identical to one another and are evenly spaced in between the diluent runners 34, the outlets 13–18 each are on an axis parallel to the head centerline and are in a circular pattern concentric to and around the head centerline. The concentrate outlets 13–18 are nearer to the head centerline than the diluent outlet openings 35 and are in a circular pattern of lesser diameter within but concentric to the pattern of the runner outlet openings 35. All of the concentrate outlets 13–18 acutely intersect with the nozzle convex bottom surface 27.

Each of the concentrate outlets 13–18 has an internal restrictor bore 36 sized to give a relatively high velocity flow of concentrate and to hold concentrate via capillary action and surface tension when not dispensing. A specific restrictor bore is 0.093 in. (2.36 mm) diameter by 0.157 in. (4.0 mm) long which works well with either sugar base or dietetic base beverage concentrates. By contrast, each of the six diluent runners 34 has a diameter of 0.115 in. (2.92 mm). With the standard ratio of five parts diluent to one part concentrate, the velocity of diluent and concentrate are in a ratio of about nine to one, specifically, while the volumetric rate of flow of concentrate through the restrictor bore is one fifth of the volumetric flow of diluent, the flow velocity or speed of concentrate is about nine times the velocity of diluent in the diluent outlet runners 34. At the bottom of each diluent outlet 13–18, there is a counter bore 37 which intersects and goes through the nozzle convex bottom surface 27, and there is a sharp angle edge 38 around the entire opening intersection between each counterbore 37 and the surface 27. The counterbore 37 has a flat upper shoulder 39 adjoining the counterbore 37 to the restrictor bore 36 and the intersection therebetween as well as the inner corner of the counterbore are both sharp cornered and at ninety degrees. The counterbores 37 are positioned as close as is structurally possible to the concavity sharp edge 32, and all of the counterbores 37 are radially inward of the diluent outlet openings 35. The counterbore 37 effectively spaces the restrictor bore 36 upward of the nozzle convex surface 27 by an amount at least equal to the diameter of the counterbore 37, and the counterbore shoulder 39 is perpendicular to both the axis of the concentrate outlet 13 and the head centerline.

The spout 19 has a downwardly extending opening bore 40 out the bottom for discharge of mixed beverage from the head 10. The opening bore 40 is of substantially constant diameter and is concentric with the head centerline. The opening bore 40 extends downward from the center of an upward facing generally concave inner surface 41 within the spout 10. The concave surface 41 is also concentric about the head centerline and is directly below the concentrate outlets 13–18. Above the concave surface 41, there is a toroidal diluent flooding chamber, generally indicated by the numeral 42, between the nozzle 11 and the spout 19. The flooding chamber 42 is formed by an upper concavity 43 around and adjacently above the concave surface 41. The upper concavity 43 is of greater diameter than the concave surface 41 and has an outer diametric surface 44 of substantially the same diameter as the nozzle 11. The upper concavity 43 has a lower surface 45 slanted downward and which is convergently angled toward the nozzle convex lower surface 27 as projected toward the head centerline. All of the intersections between the spout inner surfaces 40, 41, 45, 44 respectively, are smoothly radiused and present no sharp edge or irregular surface change to beverage flow. At the radiused intersection of the surfaces 45 and 41, there is an inner upward facing knoblike protruding apex 46 which is nearer to the nozzle convex lower surface 27 than is the deepest part or root 47 of the flooding chamber 42. The apex 46 projects directly toward the concentrate outlet counterbores 37. The height of the spout opening bore 40 is at least equal to and preferably generally equal to the length of the concave surface 41 as measured between the protruding apex 46 and the intersection between the surfaces of the bore 40 and convex surface 41.

The nozzle convex surface 27 and the spout concave surface 41 are each sections of conical revolution and these surfaces 27, 41 which are spaced apart from one another have an included angle 48 between them which is divergent towards the head centerline; these surfaces 27, 41 are convergent at a point 49 just outside of the spout diametric surface 44 and the outer diametric edge 50 of the nozzle 11. A constant length radius 51 swung from the intersection of the opening bore 40 and concave surface 41 is generally tangent to both of the head centerline and the nozzle convex surface 27. The nozzle lower sharp edge 32, which forms the level of truncation of the nozzle convex surface 27 is at a level above the theoretical tangency of the swung radius 50 to the nozzle convex surface 27, and is at a level intersecting the flooding chamber 42 and is above the level of intersection between the flooding chamber 42 and the spout concave inner surface 41 as defined by the intersection of the surfaces 41 and 45; the level of truncation and the sharp edge 32 are above the entirety of the flooding chamber lower surface 45. The included angle of the nozzle convex lower surface 27 is one hundred and twenty degrees, and the angle between the head centerline and the surface of 27 is also one hundred and twenty degrees. The divergent angle 48 between the nozzle convex surface 27 and the spout inner concave surface 41 is thirty degrees. The flooding chamber lower surface 45 is slanted downward at fifteen degrees. The head 10 is small, for example, the diameter of the spout surface 44 will be 1.025 inch (26.0 mm), the spout opening bore will have a diameter of 0.562 inch (14.3 mm) and the nozzle concavity 28 will have a diameter of 0.468 inch (11.9 mm) and a depth of 0.060 inch (1.5 mm). All of the angles in the drawing are in accordance with the best mode construction. The diluent outlet runners 34 are generally perpendicular to the spout concave inner surface 41 at a projected intersection. However, the diluent outlet runners 34 are aimed directly into the flooding chamber 42 and directly against the chamber root 47. The nozzle lower sharp edge 32 faces inwardly from the flooding chamber 42 and toward the head centerline. The concentrate outlets 13 are inward of the diluent outlet openings 35, and are aimed directly downward inside of the flooding chamber 42 and directly against the spout concave surface 41 at an acute intersection angle of thirty degrees and at an impacting intersection point at a level below the level of the flooding chamber 42. An air vent 52 is provided in the bottom of the discharge opening bore 40.

In the operation and use of the head 10, the valves 22, 24 are opened. The head 10 is particularly useful and suited for having the valves 22, 24 open and close simultaneously with each other and sequential closing of the water valve 22 after the concentrate valve 23 in order to flush the head 10 is not necessary as the head 10 is effectively self-cleaning. The volumetric flow rates may be varied throughout at least a two-to-one ratio. Specifically, a standard dispensing flow rate is 1.5 oz/sec (45 cc/sec) which is ratioed with five volumes of water per each volume of concentrate, and a fast dispensing flow rate is 3.0 oz/sec (90 cc/sec) in the same water to concentrate volumetric ratio. Both the water and concentrate will be refrigerated and at a temperature in the range of 32°–40° F. (0°–4.4° C.) and the water will be carbonated with approximately 4.0 to 5.0 volumes of carbon dioxide gas. The concentrate may be sugar or dietetic base and of such flavors as cola, orange, lemon-lime, root beer and the like. Carbonated water may be dispensed by opening the water valve 22 and leaving every concentrate valve 24 closed. The diluent water enters the head 10 through the plenum 33 and then is radially directed outward and downward through the runners 34 and into the flooding chamber 42. It's thought the water from each individual runner 34 impinges on the flooding chamber surfaces 43, 44, 45 and goes into a mushroom shape flow. This flow is represented by arrows in FIG. 2. The water flow attaches to the nozzle surface 27 and the spout surfaces 45, and then remains attached to the spout 19 by attaching to the radiused apex 46 and then to the concave spout surface 41. The water flow attached to the nozzle surface 27 seems to be directed downward off the nozzle surface 27 and past the sharp edge 32 around the concavity 28. The water flow then seems to follow the spout concave surface 41 downward and is bent as the flow is turned straight downward onto the surface of the discharge opening bore 40. The water flow discharges in an absolutely straight column devoid of large air bubbles and does not spiral, spit or wander around in a random "pretzel" form. There is minimum decarbonation and gas breakout at either of the high or low flow rates. It appears that water flow from adjacent runners 34 joins together and turns directly toward the head centerline underneath and past a concentrate outlet 13, in between the so adjacent runners 34.

The selected single concentrate is admitted through one of the concentrate outlets 13–18, for example outlet 13 of FIG. 1. The concentrate is propelled out of the restrictor bore 36 in a relatively high velocity stream that does not touch the counterbore 39, the concentrate stream is propelled right through the flowing water and against the spout concave surface 41. When the concentrate stream impacts on the surface 41, it is dispersed into a disc shape which extends generally horizontal across the surface 41 approximately at the level of impact. The concentrate then appears to be mechanically dissolved into the water stream, and virtually completely mixed within the spout 19 and discharged together with the diluent water as a mixed beverage out of the discharge opening bore 40. The discharged stream of beverage is very smooth and laminar, with no foam and very little free carbon dioxide gas.

When the valves 22, 23 are simultaneously closed, flow in the inlets 12, 13 ceases and as the concentrate ceases flow, the restrictor bore 36 remains filled with concentrate but the counterbore 37 is empty of concentrate. As the water flow ceases, the remaining water above the counterbore 37 is somewhat directed toward the counterbore 37 by the protruding apex 46 and the counterbore is rinsed and the last of the water is discharged from the spout 19. The spout 19 drains itseld immediately and any water or beverage remaining on the nozzle 19 slides down the convex surface 27 to the sharp edge 32 and is dropped almost immediately. It appears that any water or beverage in the concavity 28 is drawn by surface tension radially outward on the flat surface 30, and around the corner break fillet 31 to the sharp edge 32 where it also is almost immediately dropped. There is a small amount of liquid left in the concavity but it appears to be stable and does not drip off. During subsequent dispensing of a different beverage, the water flow does not seem to be able to draw spurious non-selected concentrate out of the restrictor bore 36.

This head offers many advantages. It is extremely small, of economical construction, is sanitary and easily cleaned, and can be used fixed in place on a machine, or in a hand held dispensing gun on the end of a length of hose. This head 10 has solved the inherent problems of mixing, and even in a tall slender glass, the beverge is well mixed without a layer of concentrate in the bottom and a layer of water on top. There is no detectable carryover of concentrate between different flavors and the head 10 is virtually drip free which helps keep the associated dispensing equipment free of splatter and relatively clean. The capability to interchangeably handle a relatively large range of volumetric flowrates is also a significant improvement.

Although other advantages may be found and realized and various modifications may be suggested by those versed in the art, it should be understood that I wish to embody within the scope of the patent warranted hereon, all such embodiments as reasonably and properly come within the scope of my contribution to the art.

I claim as my invention:

1. In an open chambered multiple flavor post-mix head for concurrent dispensing and mixing of a selected any one of a plurality of different flavored beverage concentrates and diluent, said head having a nozzle, a diluent outlet in the nozzle, a plurality of discrete concentrate outlets in the nozzle with there being one outlet for each concentrate, a spout under the nozzle for mixing together flows of diluent and a selected concentrate from a respective one of the concentrate outlets, and a downward extending opening out of the bottom of the spout for discharge of mixed beverage from the head; the improvement comprising:

a downward facing open concavity centrally located in the nozzle bottom and within the spout, said concavity being centrally within and spaced from the discrete concentrate outlets, there being a sharp edge of intersection between the concavity and a nozzle bottom surface surrounding the concavity.

2. A beverage dispensing haad improvement according to claim 1, including an internal vertical surface in the concavity and extending directly upward from the intersection edge.

3. A beverage dispensing head improvement according to claim 2, in which an upper surface of the concavity is flat and in a plane perpendicular to a centerline of the head.

4. A beverage dispensing head improvement according to claim 3, including a corner break at an intersection between the concavity vertical surface and the concavity upper surface.

5. A beverage dispensing head improvement according to any of claims 1, 2, 3 or 4, in which the nozzle bottom surface surrounding the concavity is angled upwardly an amount at least sufficient for effecting downward drainage of beverage remaining on the bottom surface downward to the sharp edge of intersection, and in which the concentrate outlets extend through the so angled nozzle bottom surface.

6. A beverage dispensing head improvement according to claim 5, in which the diluent outlet also extends through the so angled nozzle bottom surface, with a diluent opening being further from the sharp edge than a concentrate outlet opening.

7. A beverage dispensing head improvement according to either of claims 1 or 2, in which the sharp edge is an acute angle extending continually around the entirety of the concavity.

8. A beverage dispensing head improvement according to claim 1, in which the concavity is relatively shallow, with the diameter thereof being substantially greater than the depth.

9. In an open chambered multiple flavor post-mix head for concurrent dispensing and mixing of a selected any one of a plurality of different flavored beverage concentrates and diluent, said head having a nozzle, a diluent outlet in the nozzle, a plurality of discrete concentrate outlets in the nozzle with there being one outlet for each concentrate, a spout under the nozzle for mixing together flows of diluent and a selected concentrate from a respective one of the concentrate outlets, and a downward extending opening out of the bottom of the spout for discharge of mixed beverage from the head;

the improvement for reducing concentrate carryover between beverages comprising:

a downwardly facing convex bottom surface on the nozzle, said concentrate outlets being in a circular pattern through and generally concentric to the convex bottom, each of said outlets having a reduced diameter restrictor within the nozzle and a counterbore of larger diameter than the restrictor, said counterbore being through and spacing the restrictor upward of the convex bottom surface.

10. In an open chambered multiple flavor post-mix head for concurrent dispensing and mixing of a selected any one of a plurality of different beverage concentrates and diluent, said head having a nozzle, a diluent outlet in the nozzle, a plurality of discrete concentrate outlets in the nozzle with there being one outlet for each concentrate, a spout under the nozzle for mixing together flows of diluent and a selected concentrate from a respective one of the concentrate outlets, and a downward extending opening out of the bottom of the spout for discharge of mixed beverage from the head;

the improvement for reducing concentrate carryover between beverages comprising:

a nozzle bottom surface slanted downward with respect to a centerline of the head with the concentrate outlets intersecting said bottom surface and having axis substantially parallel to the centerline, each concentrate outlet having a restrictor bore and a counterbore of larger size than the restrictor bore, said counterbore being in between and spacing the restrictor bore from the slanted bottom surface, each concentrate outlet having a downward facing shoulder where the counterbore meets the restrictor bore, said shoulder being perpendicular to the outlet axis.

11. A beverage dispensing head improvement according to either of claims 9 or 10, including a sharp angle around the entire intersection between each respective counterbore and the nozzle bottom surface.

12. A beverage dispensing head improvement according to either of claims 9 or 10, including a downward facing acute edge in the nozzle bottom surface and immediately adjacent to a lowest point in an edge defined by the intersection of each counterbore with the nozzle bottom surface.

13. A beverage dispensing head improvement according to either of claims 9 or 10, in which the counterbores are inwardly positioned from a diluent flooding chamber surrounding and immediately adjacent to the counterbores.

14. A beverage dispensing head improvement according to claim 13, in which the spout has an inner upward facing protuberance facing into the counterbores for directing some diluent from the flooding chamber toward the counterbores.

15. A beverage dispensing head improvement according to claim 9, including a flat shoulder adjoining each counterbore to each respective restrictor bore.

16. In an open chamber multiple flavor post-mix head for concurrent dispensing and mixing of a selected any one of a plurality of different flavored beverage concentrates and diluent, said head having a nozzle, a diluent outlet in the nozzle, a plurality of discrete concentrate outlets in the nozzle with there being one outlet for each concentrate, a spout under the nozzle for mixing together flows of diluent and a selected concentrate from a respective one of the concentrate outlets, and a downward extending opening out of the bottom of the spout for discharge of mixed beverage from the head;

the improvement for reducing drippage and intermixing or carry-over between different concentrates, while providing for foamless mixing of diluent and concentrate within the spout, comprising in combination:

(a) a plurality of surfaces within the spout and below the nozzle outlets, said surfaces being adjoined at intersections and all of such intersections being smoothly radiused, (b) a downward facing generally convex bottom surface on the nozzle, said outlets being through the convex surface, (c) a continually sharp edged opening between the diluent outlet and the convex surface, (d) a continually sharp edged opening between each of the concentrate outlets and the convex surface, and (e) a downward facing sharp edge spaced within all of the outlet openings and at the lowest level of the bottom surface of the nozzle.

17. A beverage dispensing head improvement according to claim 16, in which the diluent outlet and all of the concentrate outlets acutely intersect with the nozzle convex bottom surface.

18. A beverage dispensing head improvement according to claim 16, in which each of the concentrate outlets has a counterbore intersecting the convex surface, and in which each counterbore intersects with a respective concentrate outlet restrictor bore with there being a continually sharp edge of intersection between the counterbores and the restrictor bores.

19. A beverage dispensing head according to claim 16, in which the downward facing sharp edge at the lowest level of the nozzle bottom surface is a continuous acute edge around the inside of the concentrate outlets.

20. In an open chambered multiple flavor post-mix head for concurrent dispensing and mixing of a selected any one of a plurality of different flavored beverage concentrates and diluent, said head having a nozzle, a diluent outlet in the nozzle, a plurality of discrete concentrate outlets in the nozzle with there being one outlet for each concentrate, a spout under the nozzle for mixing together flows of diluent and a selected concentrate from a respective one of the concentrate outlets, and a downward extending opening out of the bottom of the spout for discharge of mixed beverage from the head;

the improvement for dispensing a foamless flow of evenly mixed beverage at variable flow rates, comprising in combination:

(a) a downward facing generally convex lower surface on the nozzle, (b) an upward facing generally concave inner surface within the spout and facing towards and spaced below the lower surface of the nozzle, (c) an included angle between the convex lower nozzle surface and the concave inner spout surface which is divergent towards a common centerline of the nozzle and the spout, (d) a substantially constant diameter bore downward from the center of the concave inner spout surface, said bore forming the discharge opening from the spout, and in which (e) a constant length radius swung from the intersection of the bore surface and the concave inner spout surface is generally tangent to both of the centerline of the bore and the convex lower surface of the nozzle.

21. A beverage dispensing head improvement according to claim 20, in which the nozzle convex lower surface is truncated.

22. A beverage dispensing head improvement according to claim 21, in which the truncation is at a level above the level of tangency of the swung radius with the nozzle convex lower surface.

23. A beverage dispensing head improvement according to either of claims 21 or 22, in which the truncation is concave.

24. A beverage dispensing head improvement according to claim 20, in which the angle between the nozzle convex lower surface and the head centerline, and the included angle of the nozzle convex lower surface are substantially equal.

25. A beverage dispensing head improvement according to claim 20, in which the diluent outlet is generally perpendicular to the spout concave inner surface, and in which the concentrate outlets are inward of a diluent outlet opening and are directed at an acute angle directly against the spout concave inner surface.

26. A beverage dispensing head improvement according to claim 20, including a toroidal diluent flooding chamber adjacent to a projected convergent line between the spout concave inner surface and the nozzle convex surface, and in which the diluent outlet is aimed directly into the toroidal chamber.

27. A beverage dispensing head improvement according to claim 26, in which the height of the bore is generally equal to the length of the spout concave inner surface as measured between the toroidal chamber and the intersection with the bore surface.

28. A beverage dispensing head improvement according to either of claims 26 or 27, in which the nozzle convex lower surface is truncated at a level above the level of an intersection between the toroidal chamber and the spout concave inner surface.

29. In an open chambered multiple flavor post-mix head for concurrent dispensing and mixing of a selected any one of a plurality of different flavored beverage concentrates and diluent, said head having a nozzle, a diluent outlet in the nozzle, a plurality of discrete concentrate outlets in the nozzle with there being one outlet for each concentrate, a spout under the nozzle for mixing together flows of diluent and a selected concentrate from a respective one of the concentrate outlets, and a downward extending opening out of the bottom of the spout for discharge of mixed beverage from the head;

the improvement for dispensing an evenly mixed beverage at various rates of flow, comprising:

(a) a downward facing generally convex lower surface on the nozzle, (b) an upward facing generally concave inner surface within the spout and facing towards and spaced below the lower surface of the nozzle, (c) an included angle between the convex lower nozzle surface and the concave inner spout surface which is divergent towards a common centerline of the nozzle and spout and which is convergent in general proximity to an outer diametric edge of the nozzle lower surface, and (d) a toroidal flooding chamber between the nozzle and the spout, said chamber being formed by an upper concavity around and adjacently above said concave inner spout surface and being smooth surfaced and devoid of internal obstructions, said upper concavity being of greater diameter than the concave inner spout surface with the diluent outlet being aimed directly into the flooding chamber and against the upper concavity, and with the concentrate outlets being directed against the concave inner spout surface at a level below the level of the flooding chamber.

30. A beverage dispensing head improvement according to claim 29, in which the generally convex lower surface of the nozzle is truncated at the level of the toroidal flooding chamber.

31. A beverage dispensing head improvement according to claim 30, including a concavity centrally positioned in the bottom of the nozzle, and a sharp acute edge around the perimeter of the concavity, said sharp edge facing inward from the toroidal flooding chamber and being the lowest part of the nozzle.

32. A beverage dispensing head improvement according to claim 29, in which a lower surface in the toroidal flooding chamber is projected toward the centerline of the nozzle convergently angled toward the convex lower surface of the nozzle.

33. A beverage dispensing head improvement according to either of claims 29 or 32, in which an apex of intersection between the toroidal flooding chamber and the concave inner surface of the spout is nearer to the convex lower surface of the nozzle than a root in the toroidal chamber.

34. A beverage dispensing head improvement according to claim 32, in which the generally convex lower surface of the nozzle is truncated at a level above the level of the lower surface in the toroidal chamber.

* * * * *